US006510714B2

(12) United States Patent
Dehner

(10) Patent No.: US 6,510,714 B2
(45) Date of Patent: Jan. 28, 2003

(54) LATCH NEEDLE WITH A FIXED SPRING

(75) Inventor: Lothar Dehner, Bisingen-Thanheim (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 10/163,371

(22) Filed: Jun. 7, 2002

(65) Prior Publication Data

US 2002/0157428 A1 Oct. 31, 2002

Related U.S. Application Data

(63) Continuation of application No. 10/074,236, filed on Feb. 14, 2002, now abandoned.

(30) Foreign Application Priority Data

Feb. 15, 2001 (DE) ..... 101 06 989

(51) Int. Cl.[7] ..... D04B 35/04
(52) U.S. Cl. ..... 66/121
(58) Field of Search ..... 66/116, 121, 122, 66/123

(56) References Cited

U.S. PATENT DOCUMENTS

| | | | | |
|---|---|---|---|---|
| 3,050,968 A | | 7/1962 | Masujima | |
| 4,791,794 A | | 12/1988 | Schmoll | |
| 4,827,739 A | * | 5/1989 | Goller et al. | 66/106 |
| 5,239,844 A | * | 8/1993 | Sos | 66/12 |
| 5,956,976 A | | 9/1999 | Schaffer et al. | |
| 6,439,001 B1 | * | 8/2002 | Sahaffer | 66/121 |

FOREIGN PATENT DOCUMENTS

| | | |
|---|---|---|
| DE | 1841496 | 11/1961 |
| DE | 1113537 | 10/1967 |
| DE | 1780715 | 11/1968 |
| DE | 1410312 | 4/1969 |
| DE | 3702019 C1 | 9/1987 |
| GB | 315185 | 7/1929 |
| JP | 50-9403 | 3/1975 |

* cited by examiner

*Primary Examiner*—Danny Worrell
(74) *Attorney, Agent, or Firm*—Venable; Norman N. Kunitz

(57) ABSTRACT

A latch needle (1) has a leaf spring (8, 8') that is associated with the latch (4), that is disposed in the sawslot (3) and is held in corresponding bearing seats (14, 15) at the narrow sides or end walls (11, 12) defining the sawslot 3. Each bearing seat (14, 15) has a support surface (18) for the respective end of the spring, and at least one counterpart surface (21), with the respective end (16, 17) of the leaf spring (8) extending between these two surfaces and being held there. The axial or longitudinal play of the leaf spring (8, 8') is so small that the leaf spring (8, 8') cannot fall out of the space between the support surface (18) and the counterpart surface (21), even when it is deflected to a considerable extent. The leaf spring (8, 8') is therefore held securely in the sawslot (3).

17 Claims, 7 Drawing Sheets

LATCH NEEDLE WITH A FIXED SPRING

CROSS-REFERENCE TO RELATED APPLICATION

This application is a continuation of U.S. patent application Ser. No. 10/074,236 filed Feb. 14, 2002, now abandoned.

This application claims the priority of German Patent Application No. 101 06 989.8 filed Feb. 15, 2001, which is incorporated herein by reference.

BACKGROUND OF THE INVENTION

The invention relates to a latch needle, particularly for knitting machines.

Some knitting machines require latch needles whose latches have not only a rear position and a closed position, but at least one further pivoting position, in which the latch is flexibly held and does not rest against the hook or the needle shank. The latch that is pivotably seated in the sawslot is in contact with a leaf spring disposed in the sawslot. U.S. Pat. No. 3,050,968, for example, describes a latch needle of this type. The latch needle disclosed here is provided with a sawslot whose floor has a curved outline and is provided with an opening that leads to the back of the needle. The curved leaf spring rests against one end of the pivotably-seated latch, which end is directly adjacent to the latch seat. The two ends of the leaf spring rest against the floor of the sawslot, and span the opening. In at least one embodiment, at least one end of the leaf spring is secured to the needle body with respect to the longitudinal direction of the leaf spring. One chamfered end of the leaf spring extends into a small bore or opening formed in the floors of the sawslot.

German Published Patent Application No. DE-OS 1410312 discloses a similar latch needle, in which a leaf spring is likewise disposed in the sawslot. Unlike the needle in accordance with the above-cited prior art, however, this needle is not completely straight. Its center segment, which is in contact with the latch, has a curved region that conforms to the latch end. This arrangement secures the leaf spring in its longitudinal position. The free ends of the latch spring merely lie against the floor of the sawslot. In a further embodiment of the latch needle that is known from this document, the ends of the leaf spring lie in stepped shoulders formed at the floor of the sawslot. These shoulders, which are open to the top, each have a support surface for the respective end of the leaf spring, against which the spring rests due to its own spring tension. The spring tension is present because the end of the latch shank bends the leaf spring downward in the direction of the needle back, and the ends of the leaf spring rest on the support surfaces of the stepped shoulders.

A common feature in the prior art is that the spring is held between the latch end and the bearing seats, which are formed either by the floor of the sawslot or by separate stepped shoulders formed therein. The prestressing under which the spring is seated in the sawslot determines how reliably the spring is held in the sawslot. The greater the selected prestressing, the greater the friction and the force between the latch and the leaf spring. This can make the latches sluggish, and adversely affect the functioning capability of the latch needle, which in turn negatively influences the uniformity of the stitch formation. In an extreme case, sluggish latches will tear the threads, which leads to a halt in production.

Furthermore, it cannot be ruled out that the leaf spring may fall or be pushed out of the sawslot, at least in atypical operating situations.

SUMMARY OF THE INVENTION

It is therefore the object of the invention to provide a latch needle having an improved functioning capability.

The above object is achieved according to the invention by a latch needle that has an oblong or elongated leaf spring that is disposed in the sawslot and is held by its ends at corresponding bearing seats. The bearing seats are disposed at the narrow sides or end faces of the sawslot, and have a respective support surface and at least one counterpart surface located essentially opposite the support surface. The end of the leaf spring is therefore held between the support surface and the counterpart surface, and cannot leave the bearing seat. The counterpart surface can be formed as a projection that is connected to the narrow side of the sawslot, or on one or more projections provided at the elongated sides or edge cheeks of the sawslot.

This embodiment of the bearing seat with a support surface and a counterpart surface permits two options for mounting the leaf spring.

First, the spring end of the leaf spring is held with a form fit, and with little play, in the bearing seat. The leaf spring can therefore execute both a certain axial movement, as well as a pivoting movement, at least in a sufficient range, unimpeded.

In another mounting option, the leaf spring is mounted under a prestress, so its ends are held in the bearing seat without axial play and under tension.

In both options, the ends of the leaf spring are clamped loosely (i.e., so as to pivot and be axially displaced within limits). Despite this, the leaf spring is reliably prevented from inadvertently falling out. The function of the latch needle is thus maintained. This prevents errors or impediments to function that could occur if the leaf spring were to be lost.

Despite being secured by both ends in the bearing seats, the spring maintains its spring characteristic. Impediments to the spring characteristic, as would occur if the ends of the leaf spring were welded to the bearing seats or otherwise fixed to be axially stationary, are precluded.

A further advantage of the latch needle according to the invention lies in the greater flexibility in designing the shape of the leaf spring and its spring characteristic. For example, the leaf spring can be formed such that it is not permanently in contact with the end of the latch. Consequently, the friction between the leaf spring and the latch can be reduced, which permits the production of needles having a particularly easy-running, spring-supported latch.

The needle in accordance with the invention is not only insensitive with respect to various operating conditions, but also with respect to unforeseen handling, such as being blown with compressed air, for example, to clean the knitting machine. The leaf springs are held securely due to the special embodiment of the bearing seat, so the compressed air only causes them to slide slightly, and cannot blow them out of the sawslot.

In an advantageous embodiment, the leaf spring is held at the bearing seats such that it is displaceable axially, that is, in its longitudinal direction, to a limited extent. This means that the spacing between the bearing seats is slightly larger than the axial length of the leaf spring in the mounted state, so the leaf spring has axial play. The axial position of the leaf spring is determined by, for example, a region of the leaf spring that is curved in a V-shape or other shape and is in contact with the bearing-side end of the latch. This can reduce the influence of production tolerances, in terms of the precise arrangement of the latch seat and the position of the leaf spring, on the function of the latch needle. In addition, the impediment or influencing of the spring characteristic will be prevented because the spring is not clamped to or in the bearing seal. In another embodiment, the ends of the leaf spring are held under tension at the bearing seats. Here, the leaf spring cannot be displaced in the axial, that is, longitudinal, direction. It is therefore possible to influence the prestressing of the leaf spring. Also in this embodiment, it is critical that the ends of the leaf spring not be permanently or rigidly fixed. They are tensed, but can move in the bearing seats.

The bearing seats are preferably formed such that the leaf spring is not fixedly clamped to the bearing seats. The leaf spring is seated to move. This contributes to the functioning reliability and quality of the latch needle. The bearing seats do not negatively influence the spring characteristic.

The counterpart surface and the support surface can form a pocket, into which the relevant end of the leaf spring projects. This represents a particularly reliable method of seating of the leaf spring.

The latch needle can be formed such that the leaf spring rests permanently against the latch in a region between its ends, and is therefore prestressed. As an alternative, however, a slight distance can be present between the latch and the leaf spring, so the latch only rests against the leaf spring when the latch is in the vicinity of its end positions.

Advantageous details of embodiments of the invention ensue from the drawing, the description or the dependent claims.

The drawings illustrate exemplary embodiments of the invention.

DESCRIPTION OF THE PREFERRED EMBODIMENTS

Figure 1:
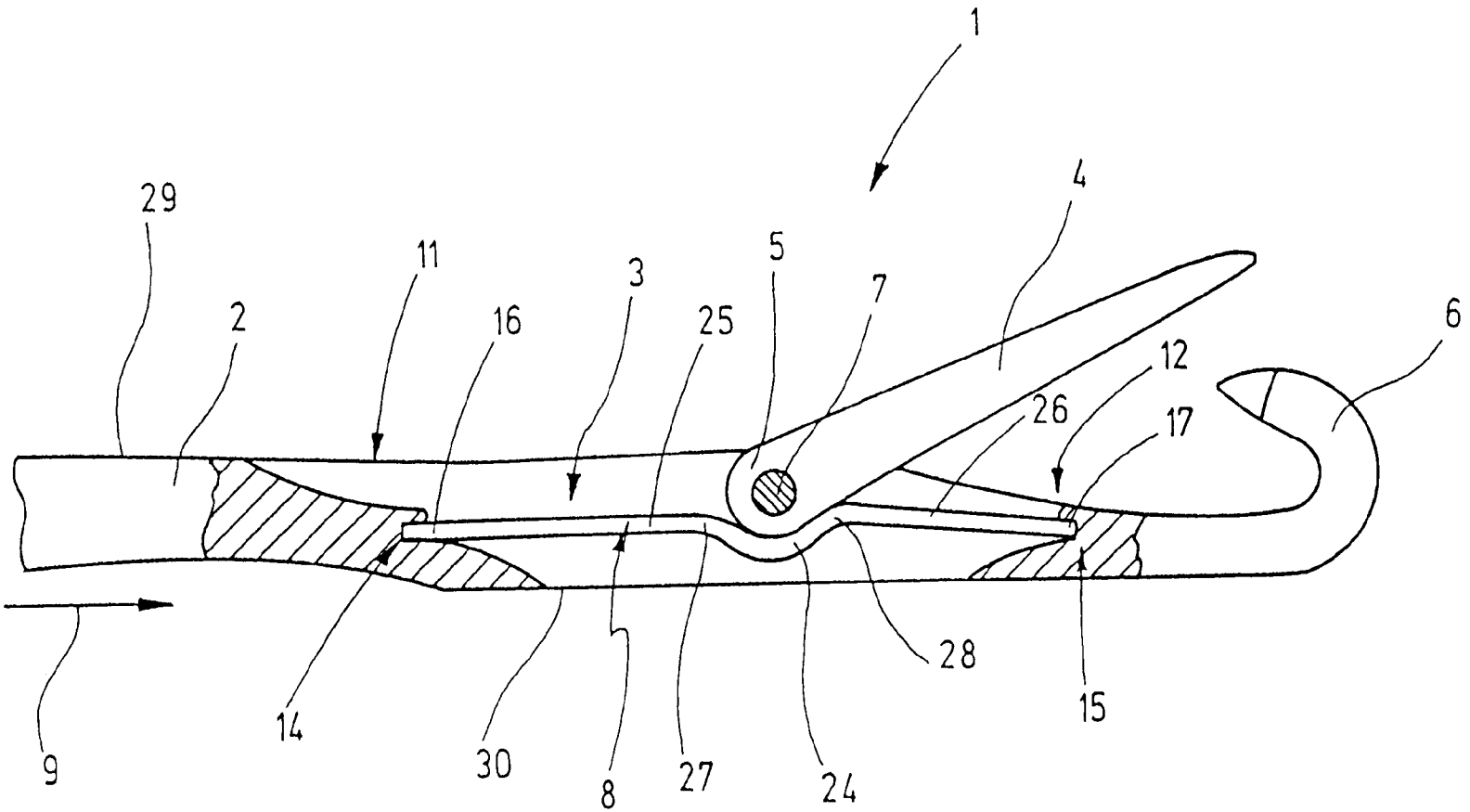
FIG. 1 is a schematic, partial longitudinal sectional view of the latch needle according to the invention with the latch in a stable position.

FIG. 1 shows a latch needle 1, which has a needle body or shank 2 with a sawslot 3 formed therein. A latch 4 extends with its end 5 into the sawslot 3, where it is seated to pivot. The latch 4 and a hook 6 formed at one end of the needle body or shank 2 form a yarn space, which the latch 4 opens and closes. A pin 7 extending transversely to the longitudinal axis of the needle through the sawslot 3 serves as a pivot axis in pivotally seating the latch 4. The sawslot 3 extends through the needle body or shank 2 from the needle top sides 29 toward the needle back 30. In the preferred embodiment, the sawslot 3 is open at the needle top side 29 and at the needle back 30.

Disposed in the sawslot 3 is a leaf spring 8, which extends approximately parallel to the longitudinal direction (arrow 9) of the needle body 2, and/or parallel to the side cheeks of the sawslot 3.

Figure 4:
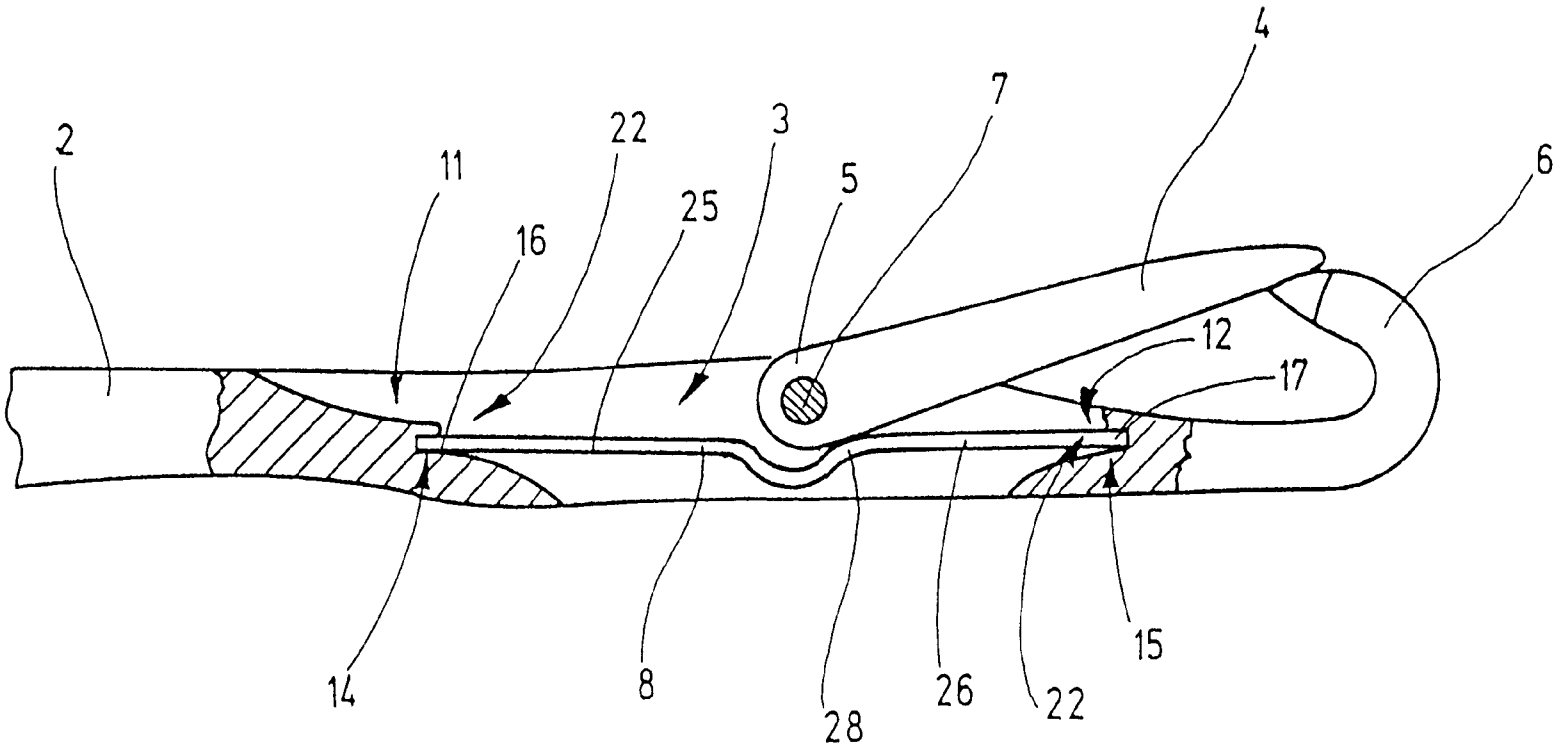
FIG. 4 is a schematic, partial sectional view of the latch needle according to FIG. 1, with the latch in the closed position.
Figure 5:
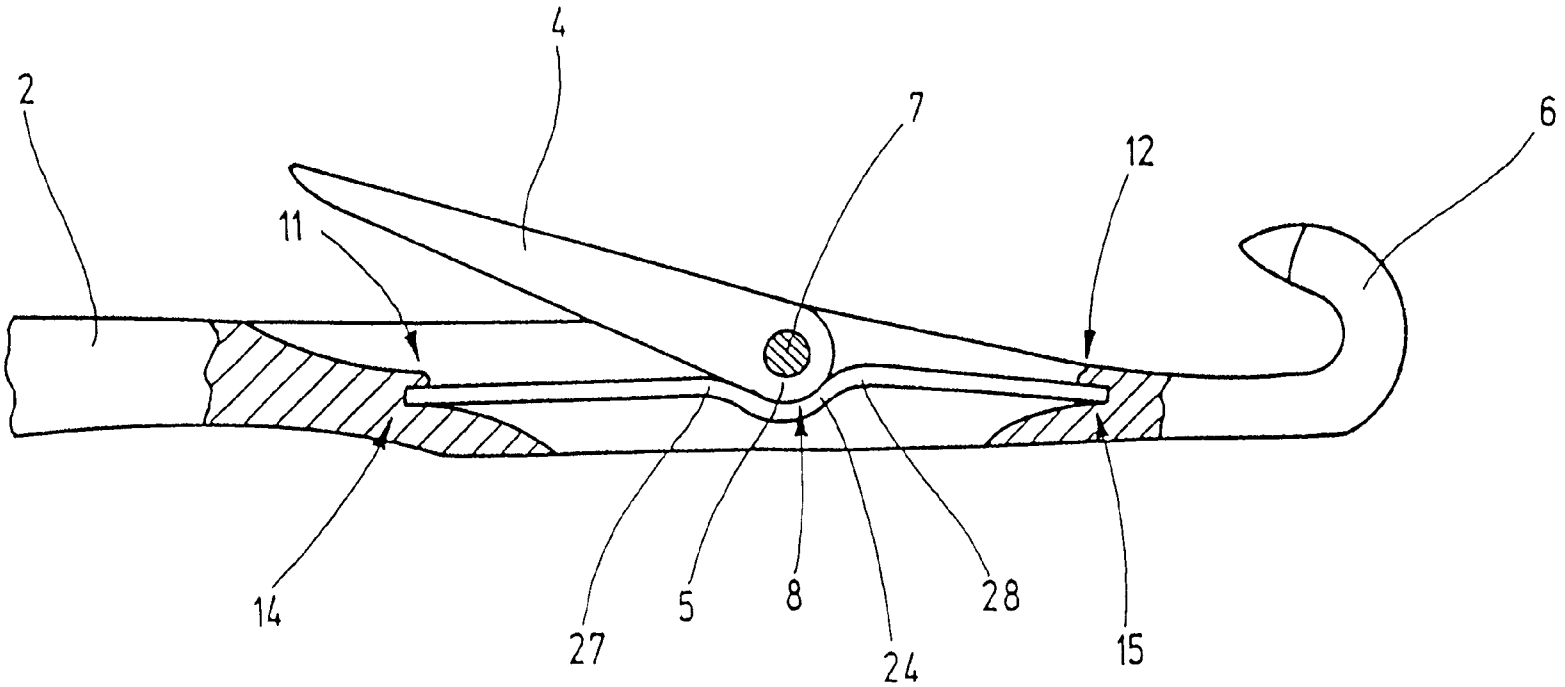
FIG. 5 is a schematic, partial sectional view of the latch needle according to FIG. 1, with the latch in a stable rear position.

The leaf spring 8 serves in guiding the latch 4 out of its two end positions, i.e., the closed end position of FIG. 4 to the stable position of FIG. 1, and out of the opposite open end position to the other stable position of FIG. 5. For example, the leaf spring 8 lifts the latch 4 from the hook 6 and transfers it into the selected intermediate position shown in FIG. 1. This makes it easier for another device provided for opening the latch 4, such as a brush (not shown), to engage the latch 4.

The sawslot 3 is formed by two longitudinal elongated sides end surfaces, which are formed by the slot cheeks, and two narrow sides or end surface 11, 12 of the shank or body 2, at which bearing seats 14, 15 for the leaf spring are formed. These seats 14 and 15 serve to secure the respective ends 16, 17 of the leaf spring 8, so that the leaf spring 8 cannot come out of the sawslot 3.

Figure 2:
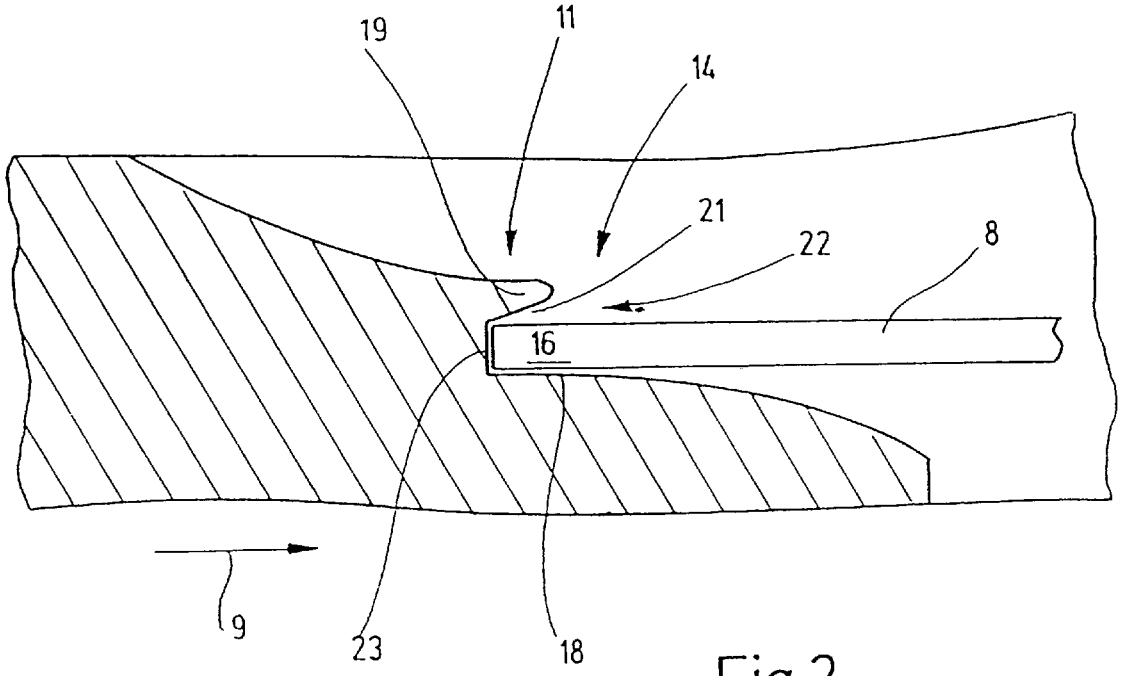
FIG. 2 is a sectional representation and on an enlarged scale of a spring bearing for the latch needle according to FIG. 1.

The bearing seats 14, 15 are approximately mirror-symmetrical relative to one another. In FIG. 2, the bearing seat 14 represents both bearing seats 14, 15. The following description of the bearing seat 14 thus also applies for the bearing seat 15.

The bearing seat 14 has a support surface 18, which is oriented essentially parallel to the leaf spring 8. The support surface 18 can have a planar surface or a slightly arched surface. Its width, measured transversely to the longitudinal direction (arrow 9), is somewhat larger than the width of the leaf spring 8. The width of the leaf spring 8 is somewhat smaller than that of the sawslot 3, so the leaf spring can move transversely between the slot cheeks.

Opposite the support surface 18, a counterpart surface 21 is formed by a projection 19 formed on the narrow side surface 11. The projection 19 extends in the longitudinal direction past the end 16 of the leaf spring 8, thus forming a pocket or groove 22 with the support surface 18 in the end wall or side 11, with the pocket 22 being deep enough to hold the end 16 securely.

Figure 3:
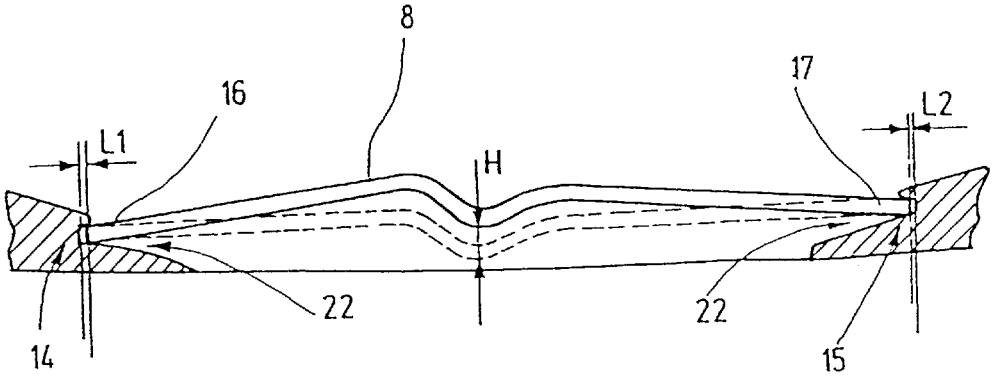
FIG. 3 is a cutout representation showing the geometric proportions of the leaf spring for the latch needle according to FIGS. 1 and 2.

As shown in FIG. 3, the leaf spring can execute a certain stroke H that leads to a certain change in length L1, L2 at the ends 16, 17. The position of the pockets 22 formed at the bearing seats 14, 15 is such (in the embodiment according to FIG. 3) that the leaf spring 8 does not impact the floor or end surface 23 of the pocket 22 with its ends 16, 17 when it has attained its maximum longitudinal extension. The pockets 22 are also so deep, that is, the counterpart surfaces 21 of the projections 19 are so long, that the leaf spring 8 cannot fall out of the pockets 22, even when it has reached its maximum deflection or displacement. The depth of the pocket 22 at least corresponds to the axial play of the leaf spring 8 plus the two distances Ll and L2 defined by the length change of the leaf spring.

As can also be seen in FIG. 1, disposed in approximately the center region of the leaf spring 8 is a segment or region 24 that is curved toward the needle back 30, for example, in a V-shape, and rests resiliently against the end 5 of the latch 4 adjacent the pivot axis 7. Extending away from the V-shaped segment 24 are two legs 25, 26 of the leaf spring 8. A transition 27 of the V-shaped segment 24 to the leg 25 serves in supporting the latch 4 when it is in the rear or open end position and moves the latch to the stable rear position shown in FIG. 5. As FIG. 1 shows, a corresponding transition 28 supports the latch 4 when it is near its closed position and in its closed position as shown, for example, in FIG. 4.

Figure 8:
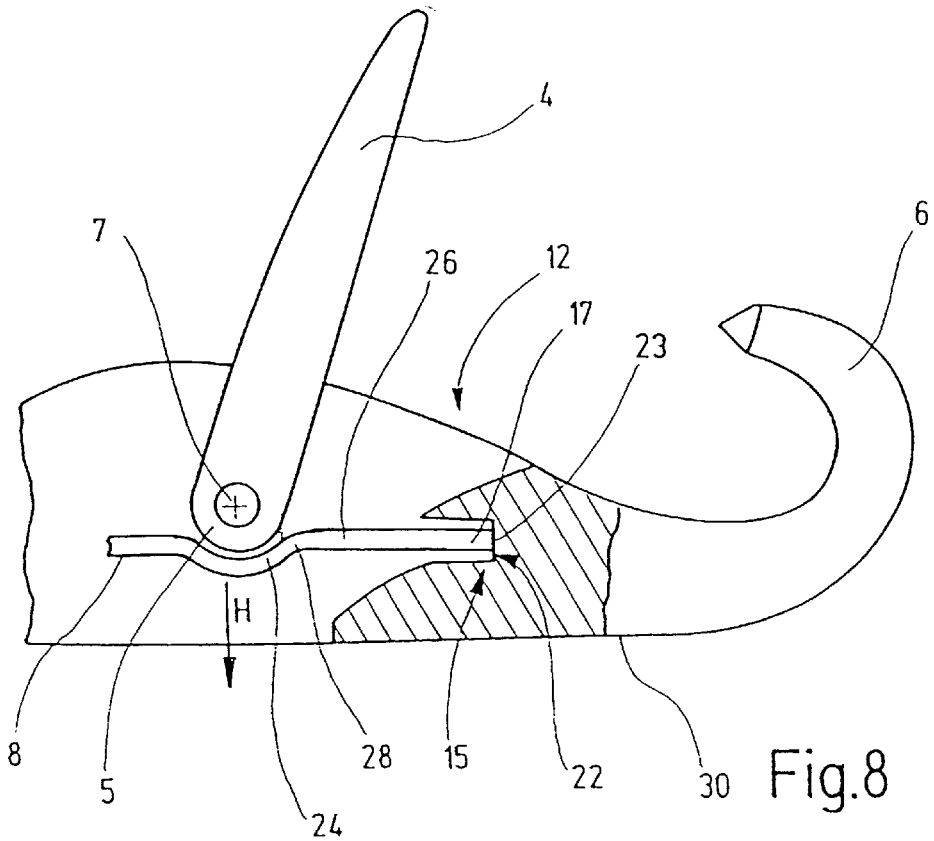
FIG. 8 is a schematic, partial sectional view of the latch needle according to FIG. 1, with a prestressed leaf spring.
Figure 9:
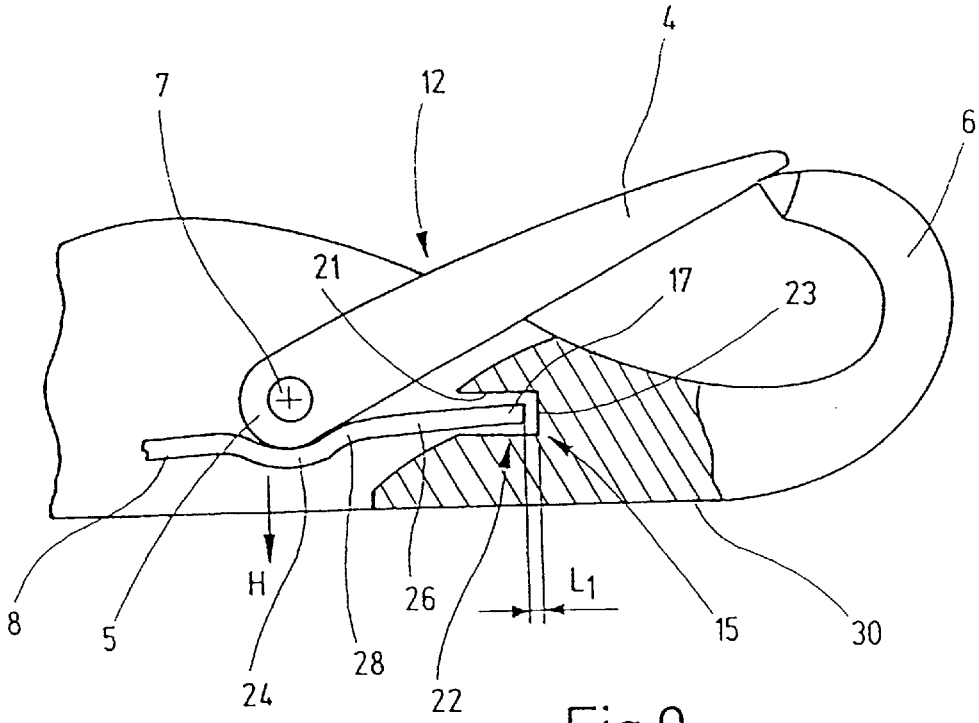
FIG. 9 is a schematic, partial sectional view of the latch needle according to FIG. 1, with a released leaf spring and the latch in the closed position.

FIGS. 8 and 9 illustrate a different embodiment. In this instance, the bearing seat 15 represents both bearing seats 14 and 15. The following description of the bearing seat 15 thus also applies for the bearing seat 14. The leaf spring 8 is held in the bearing seat 15 through prestressing. That is, its end 17 rests on the floor 23 of the pocket 22 so that the end 17 of the spring 8 and the floor 23 of the pocket 22 are stressed. If the leaf spring 8, which scarcely touches the latch 4, or not at all, in its initial position, executes a stroke H in the direction of the needle back 30, the ends 16, 17 of the leaf spring 8 move away from the floor 23 of the pockets 22 due to the changes in length L1, L2, resulting in the effective shortening of the leaf spring 8. The leaf spring 8 can then move freely. Moreover, the pockets 22 are so deep, that is, the projections 19 with their counterpart surfaces 21 are so long, that the leaf spring 8 cannot fall out of the pockets 22, even when it reaches its maximum deflection. The depth of the pocket 22 at least corresponds to the changes in length L1 and L2.

The latch needle 1 described in connection with FIGS. 1 through 5 operates as follows:

During operation, the leaf spring 8 rests against the latch 4. The latch 4 is continuously moved back and forth in the direction of the arrow 9, and counter to it, by the back-and-forth movement of the latch needle 1, as well as by the effect of additional actuation elements (not shown), such as brushes or the like. When a loop slides over the latch 4, it is briefly pressed against the hook 6 in its closed end position, as shown in FIG. 4. The latch 4 deflects the leaf spring 8 in the direction of the needle back 30 by pressing the leaf spring 8 in the direction of the needle back 30 at the transition 28. In the process, the leaf spring 8 is resiliently deformed, causing the legs 25, 26 to pivot slightly about their respective bearing seat 14, 15. As FIG. 2 shows, the play of the respective end 16, 17 of the leaf spring 8 in the bearing seat 14, 15 provides an adequate pivotability, as well as axial play, to prevent a negative influence on the spring characteristic of the leaf spring 8. Thus, only a spring force directed toward the needle back 30 is supported at the bearing seat 14, 15, i.e., the respective bearing seats 14, 15 are free from axial forces.

Once the latch 4 is released from the position shown in FIG. 4, it is returned to the selected stable position shown in FIG. 1 due to the spring force of the leaf spring 8.

Corresponding conditions apply for the rear stable position of the latch 4 shown in FIG. 5. The illustrated stable position is one in which the transition 27 supports the latch 4, and prevents it from resting against the needle body 2. The deflection of the leaf spring 8 allows the latch 4 to be pressed against the needle body 2 and into the rearward end position. The resilient effect of the leaf spring 8 then returns the latch 4 to the illustrated stable position.

Figure 6:
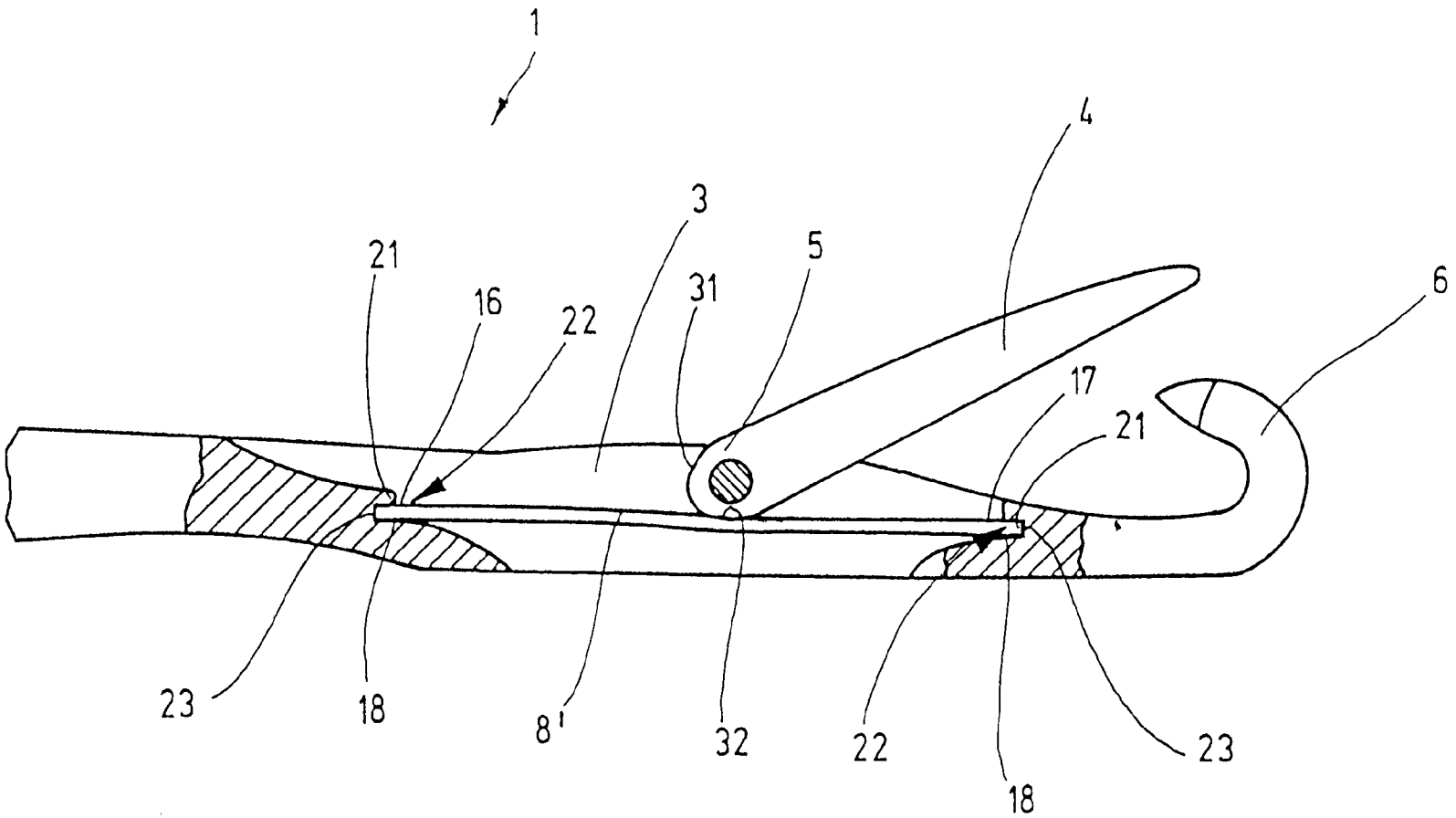
FIG. 6 is a schematic, partial sectional view of a modified embodiment of the latch needle according to the invention.

FIG. 6 illustrates a modified embodiment of the latch needle 1. In this embodiment of the latch needle 1, an extended leaf spring 8' without the V-shaped segment 24 is disposed in the sawslot 3. The leaf spring 8' can either be completely straight or slightly curved. For defining at least one, preferably two, stable positions of the latch 4, the latch 4 has flattened regions 31, 32 at suitable locations on the latch end 5. These regions 31, 32 rest flat against the leaf spring 8' in the desired stable positions of the latch 4. Thus, pivoting the latch 4 out of abutment of one of the two flattened positions 31 and 32 results in deflection of the leaf spring 8' by the portion of the end 5 between or adjacent to the flattened positions. The above explanations apply to the securing of the leaf spring 8' in the sawslot 3.

Figure 7:
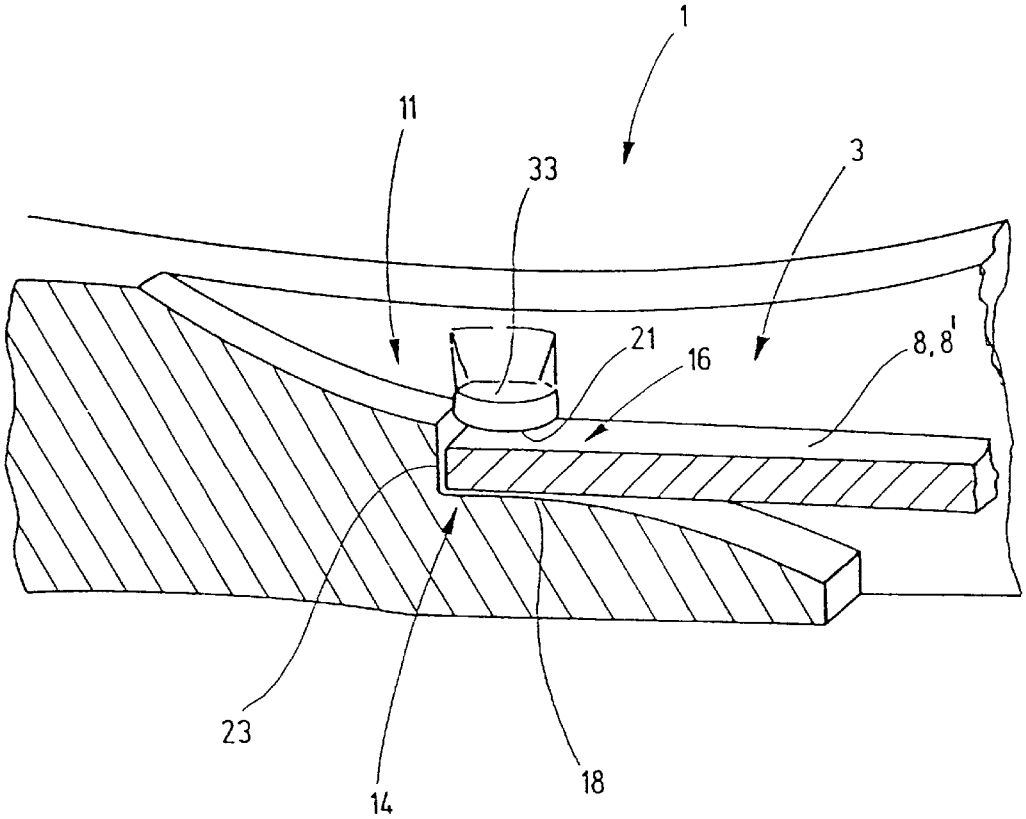
FIG. 7 is a schematic, cutout longitudinal section view of a further embodiment of a latch needle according to the invention.

FIG. 7 shows a further alternative embodiment of a latch needle 1. In comparison to the two above-described embodiments, the modification merely involves the embodiment of the bearing seats 14, 15, with the bearing seat 14 representing the bearing seats in FIG. 7. The bearing seat is defined by a shoulder formed on the narrow side or end surface 11 of the sawslot 3. At this shoulder, the support surface 18 changes over, in a step that forms the floor or endwall 23, and then into the remaining extension of the narrow-side border of the sawslot 3. At least one projection 33, which can be pressed out of the longitudinal wall or cheeks forming the sawslot 3 and provides the counterpart surface 21 on its side facing the leaf spring 8 or 8', serves in securing the end 16 of the leaf spring 8 or 8' in the sawslot 3. As an option, a similar projection 33 can also be formed in the opposite elongated wall or cheek forming the sawslot 3, which opposite wall or cheek is cut away in FIG. 7.

FIGS. 8 and 9 illustrate a latch needle 1 in which, as mentioned above, the mounted leaf spring 8 is under a prestress. In this embodiment, the leaf spring 8 does not touch the latch 4 initially (FIG. 8). The leaf spring 8 and the latch 4 do not engage until the latch 4 is moved, for example, in the direction of the hook 6 when the stitch is cast off. The leaf spring 8 then moves in the direction of the needle back 30 due to the executed stroke H as shown, for example, in FIG. 9. The ends 16, 17 of the leaf spring 8 move away from the floor 23 of the pockets 22. The leaf spring 8 can then move freely in the pockets 22 (FIG. 9). The spring characteristic of the leaf spring 8 is not adversely affected by this. Otherwise, the fundamental movement of a latch needle 1 according to FIGS. 8 and 9 is the same as described above.

In summary, A latch needle 1 according to the invention has a leaf spring 8, 8' which is associated with the latch 4, which is disposed in the sawslot 3 and is held in corresponding bearing seats 14, 15 at the narrow end walls or sides 11, 12 defining the sawslot 3. Each bearing seat has a support surface 18 and at least one oppositely disposed counterpart surface 21, with the relevant end 16, 17 of the leaf spring 8 extending between these two surfaces and being held there. Furthermore, the axial or longitudinal play of the leaf spring 8, 8' is so small that the leaf spring 8, 8' cannot fall out of the space between the support surface 18 and the counterpart surface 21, even when the spring is deflected to a considerable extent. This ensures that the leaf spring 8, 8' cannot fall out of the sawslot 3.

The invention now being fully described, it will be apparent to one of ordinary skill in the art that many changes and modifications can be made thereto without departing from the spirit or scope of the invention as set forth herein.

What is claimed is:

1. A latch needle for knitting machines comprising:

a substantially flat needle shank having a hook at a front end and provided with an elongated sawslot that extends in a longitudinal direction of the needle into the shank from a front side of the shank toward a needle back side and that has two oppositely disposed narrow sides;

a latch having one end extending into the sawslot and pivotally mounted for pivotal motion about an axis extending transverse to the longitudinal direction of the needle between a closed end position, wherein the latch engages the hook, and a rearward end position;

an elongated leaf spring disposed in the sawslot and having opposite ends thereof supported in respective bearing seats disposed at the narrow sides of the sawslot, said leaf spring being positioned in the sawslot to engage the one end of the latch with its surface facing the front side of the shank at least during pivotal movement of the latch; and, wherein the bearing seats each have a support surface for the respective end of the leaf spring and a counterpart surface located opposite the support surface and between which the respective end of the leaf spring extends.

2. The latch needle according to claim 1, wherein the support surface and the counterpart surface of at least one bearing seat are formed such that the respective end of the leaf spring is held at the respective bearing seat so as to be displaceable in the longitudinal direction.

3. The latch needle according to claim 1, wherein the support surface and the counterpart surface of the two bearing seats are formed such that the leaf spring is held at the respective bearing seat so as to be displaceable to a limited degree in the longitudinal direction.

4. The latch needle according to claim 1, wherein each end of the leaf spring is held with play between the support surface and the counterpart surface of the respective bearing seat.

5. The latch needle according to claim 1, wherein the support surface and the counterpart surface of each bearing seat forms a pocket for receiving a respective end of the leaf spring.

6. The latch needle according to claim 5, wherein the support surface and the counterpart surface of the respective pocket that receives a respective end of the leaf spring are limited in the longitudinal direction by a pocket floor formed by a portion of the narrow side of the sawslot.

7. The latch needle according to claim 6, wherein at least one end of the leaf spring each touch the floor of the respective pocket.

8. The latch needle according to claim 7, wherein the leaf spring is stressed.

9. The latch needle according to claim 1, wherein the one end of the latch extending into the sawslot rests against the surface of the leaf spring facing the front side of the needle shank in a region of the leaf spring provided between its ends.

10. The latch needle according to claim 1, wherein the one end of the latch has at least one flattened region for stabilizing a selected pivoting position between the closed and rearward positions, with the flattened region being positioned to rest against the spring when the latch is in the selected pivoting position.

11. The latch needle according to claim 10, wherein the leaf spring is normally substantially flat.

12. The latch needle according to claim 1, wherein the leaf spring has a curved segment that rests against the one end of the latch.

13. The latch needle according to claim 12, wherein the curved segment extends in a direction toward the back of the shank, and is V-shaped whereby the latch is normally maintained in pivot position between the closed and rearward end positions.

14. The latch needle according to claim 13, wherein the leaf spring is a flat spring having the curved segment in substantially its center and transition regions between the curved segment and remaining portions of the leaf spring, whereby pivoting the latch from the normally maintained pivot position causes the latch to engage a transition region and stress the leaf spring.

15. The latch needle according to claim 1, wherein: the leaf spring is held in the bearing seats; and, the length of each counterpart surface in the longitudinal direction of the leaf spring exceeds the maximum spring stroke in the longitudinal direction resulting from further stressing and shortening of the leaf spring during pivoting of the latch into one of its closed and rearward end positions.

16. The latch needle according to claim 1, wherein at least one of the counterpart surfaces is a projection extending into the sawslot in the longitudinal direction at a narrow side of the sawslot.

17. The latch needle according to claim 1, wherein at least one of the counterpart surfaces is a projection extending into the sawslot in a direction transverse to the longitudinal direction from a longitudinal side of the sawslot.

* * * * *